US010287157B2

(12) United States Patent
Bowden

(10) Patent No.: US 10,287,157 B2
(45) Date of Patent: May 14, 2019

(54) EQUESTRIAN REIN SET

(71) Applicant: Krissy Bowden, Crook (GB)

(72) Inventor: Krissy Bowden, Crook (GB)

( * ) Notice: Subject to any disclaimer, the term of this patent is extended or adjusted under 35 U.S.C. 154(b) by 282 days.

(21) Appl. No.: 15/121,657

(22) PCT Filed: Feb. 5, 2015

(86) PCT No.: PCT/GB2015/050317

§ 371 (c)(1),
(2) Date: Aug. 25, 2016

(87) PCT Pub. No.: WO2015/128602

PCT Pub. Date: Sep. 3, 2015

(65) Prior Publication Data

US 2016/0368759 A1 Dec. 22, 2016

(30) Foreign Application Priority Data

Feb. 25, 2014 (GB) ..... 1403325.2

(51) Int. Cl.
*B68B 1/04* (2006.01)

(52) U.S. Cl.
CPC ..... *B68B 1/04* (2013.01); *B68B 2001/048* (2013.01)

(58) Field of Classification Search
CPC ..... B68B 1/04; B68B 2001/042; B68B 2001/044; B68B 2001/046; B68B 2001/048
See application file for complete search history.

(56) References Cited

U.S. PATENT DOCUMENTS 66,312 A * 7/1867 Donehoo ..... B68B 1/04 54/6.1
88,210 A * 3/1869 Reardon ..... B68B 1/04 54/6.1
347,162 A * 8/1886 Davis ..... B68B 1/06 54/16
781,176 A * 1/1905 Barrick ..... B68B 1/06 54/16
1,030,022 A * 6/1912 Shank ..... B68B 1/06 235/144 SP
1,159,291 A * 11/1915 Telford ..... B68B 1/04 54/36

(Continued)

FOREIGN PATENT DOCUMENTS

DE 2851073 A1 * 6/1980 ..... A01K 15/04
DE 3201931 A1 8/1983

(Continued)

OTHER PUBLICATIONS

Machine translation of FR 727424 to Franchomme, dated Jun. 1932.*

(Continued)

*Primary Examiner* — Kathleen I Alker
(74) *Attorney, Agent, or Firm* — Kinney & Lange, P.A.

(57) ABSTRACT

An equestrian rein set comprises at least one first rein, one end thereof attachable to a component of a bridle, and at least one second rein. The second rein has attachment means at each end thereof. The attachment means at one end of the second rein is configured for attachment to a saddle and the attachment means at another end of the second rein element is configured for attachment to the first rein.

7 Claims, 4 Drawing Sheets

(56) References Cited

U.S. PATENT DOCUMENTS

| | | | | |
|---|---|---|---|---|
| 2,426,716 | A | 9/1947 | Telford | |
| 5,094,062 | A | 3/1992 | Clark | |
| 6,725,810 | B2 * | 4/2004 | Schwartz | A01K 15/02 119/712 |

FOREIGN PATENT DOCUMENTS

| | | | | |
|---|---|---|---|---|
| DE | 202011101439 | U1 | 8/2011 | |
| EP | 2537795 | A1 | 12/2012 | |
| FR | 727424 | A * | 6/1932 | B68B 1/04 |
| FR | 2930537 | A1 | 10/2009 | |
| WO | WO99/37579 | A1 | 7/1999 | |

OTHER PUBLICATIONS

Machine translation of EP 2537795 to Micropoulos, dated Dec. 2012.*

International Search Report and Written Opinion from PCT Application Serial No. PCT/GB2015/050317, dated Sep. 3, 2015, 13 pages.

* cited by examiner

EQUESTRIAN REIN SET

FIELD OF THE INVENTION

The present invention relates to an improved equestrian rein set, and in particular to an equestrian rein set that may be used in a conventional manner, yet is adapted to provide a rein aid to the equine independently of the rider.

BACKGROUND OF THE INVENTION

Control of an equine, most typically a horse or pony, whilst being ridden under saddle and bridle is achieved by the rider and depends on the rider's level of ability and physical attributes. The riders achieves control of the equine through the seat, that is the distribution of the rider's weight to the body of the equine through the saddle; through the reins; and by changing the position of the rider's legs with respect to the body of the equine.

In order to become an effective rider and work in co-operation with an equine, riders must learn to use their hands independently of their seat and legs. Riders seek to maintain a soft consistent contact with the equine's mouth through the reins, hands and arms. If an equine leans on the reins or pulls its head down the rider may have problems controlling the equine. Such habits may cause the rider to lose confidence, balance and control of the equine. This is a particular problem for young children, who do not have the strength or weight of adults and who may not have the riding experience or ability of older riders. It is not uncommon for an equine, particularly a child's pony, to reach down for grass whist being ridden. Often inexperience children will be pulled forward out of the saddle. The child may be pulled forward such that it is unbalanced, losing control, or may be pulled right out of the saddle and fall to the ground.

This is not a new problem. Many forms of bridle work have been developed to address this. For example, a type of rein known as a "grass rein" is commonly used. A "grass rein" is separate from the rein held in the rider's hands. One type of grass rein is attached at one end to the bit ring and at the other end to the saddle, usually to one of the saddle's D-rings. Such grass reins are typically used in pairs. Another type of grass rein extends from one of the saddle's b-rings, through one of the bit rings, over the equine's poll, through the other bit ring and back to a D-ring on the opposite side of the saddle. These grass reins work in different ways. The first type provides a fixed length of rein so that if the equine snatches or lowers its head, a force is exerted on the bit. The second type again provides a fixed length of rein, but exerts pressure on the poll as well as on the bit.

Both these types of "grass rein" can be effective in preventing an equine from lowering its head and/or snatching at the bit. However, they are considered by some to be unsightly, some equines resist them and in some competitive disciplines they are not permitted.

It is not just in children's riding where the rider may experience the reins being pulled out of the hands. Adult riders may experience this also. The equine may snatch at the bit, and hence the reins and rider's hands, out of habit or due to discomfort in the mouth, or lack of experience in being controlled by a rider through the bridle.

U.S. Pat. No. 2,426,716 illustrates a control device for horses that is very similar to the first type of "grass rein" described above.

A number of attempts, in addition to the use of "grass reins" as described above, have been made to develop bridles that address the above-mentioned problems.

For example, DE 3,201,931 describes a rein that includes a flexible element at the end of the rein that attaches to the bit. The flexible element extends between the bit ring and a clip attached to the rein. Without any force exerted on the rein, the end of the rein between the bit ring an the clip lies loose. When the rider exerts a force on the rein, force example to ask the equine to slow down, that force must first stretch the flexible element to the same length as the length of rein between the bit ring and the clip before the full force from the rider may be transferred to the bit. Hence, there is a gradual build up of force on the bit. It is asserted that such reins are beneficial for riders who fidget with their hands or use their hands too harshly.

FR 2,930,537 describes a variation on a "draw rein", the variation being that instead of the draw rein passing through the bit rings, it passes through rings attached by clips to the ends of the reins proximate the bit rings and that the ends of the draw rein that attach to the saddle do so by means of an elastic element.

U.S. Pat. No. 5,094,062 describes a variation on a rein that is known as both a, "German Martingale" and a "Market Narborough". Such a device in effect combines a conventional rein with a draw rein. A conventional rein attaches to the bit rings and two second reins extend from the girth, through the bit rings and attach to clips on the standard reins. The variation described in U.S. Pat. No. 5,094,062 is that instead of the second reins attaching to the girth under the body of the equine, the second reins attach to D-rings on the saddle.

Both FR 2,930,537 and U.S. Pat. No. 5,094,062 multiply the amount of force a rider can exert on the equine through the bit through the mechanical advantage provided by securing the reins at one end to the saddle or girth of the equine. Such items of equipment would not normally be considered suitable for children or other inexperienced riders.

WO 99/37579 describes an equestrian control aid which in addition to the standard reins held in the rider's hands provides to each side of the equine's head a rein that extends from the D-ring of the saddle, through the bit, through a clip attached to the bridle proximate the brow band thereof, and back to through the D-ring, forming a triangular loop. The rein that forms the control aid may be substantially inextensible or may include a flexible part.

None of the attempts to address the above described problems address the problem of appearance. Furthermore, all of the above-mentioned devices, with the exception of the rein described in DE 3,201,931 would add considerably to the time required to prepare the equine to be ridden.

It is therefore the aim of the invention to provide an improved rein that is effective in preventing an equine from lowering its head or snatching at the bit, is quick and straightforward to attach, and which is not unsightly.

SUMMARY OF THE INVENTION

According to the invention there is provided an equestrian rein set comprising at least one first rein, one end thereof attachable to a component of a bridle, and at least one second rein, the second rein having attachment means at each end thereof, wherein the attachment means at one end of the second rein is configured for attachment to a saddle and wherein the attachment means at another end of the second rein element is configured for attachment to the first rein.

Preferably, the equestrian rein set comprises two first reins and two second reins, each of the first reins attachable to components of the bridle on opposing sides of the bridle, and each of the second reins attachable to a respective one of the first reins and the saddle.

Advantageously, the or each second rein element includes a resilient part.

Advantageously, the first rein comprises at least one attachment element to which the second rein element may attach.

The first elongate rein may comprise a plurality of spaced apart attachment elements.

The attachment element may be a hole or a D-ring.

The attachment means of the second rein may be configured to attach to a D-ring.

The attachment means at one or both ends of the second rein may include at least one of one of: a clip, a strap, a tie and a buckle.

The or each first rein may have an inner surface and an outer surface and the second rein may be attachable to the first rein from the inside thereof.

BRIEF DESCRIPTION OF THE DRAWINGS

In the drawings, which illustrate preferred embodiments of the invention and are by way of example.

DETAILED DESCRIPTION OF THE PREFERRED EMBODIMENTS

Figure 1:
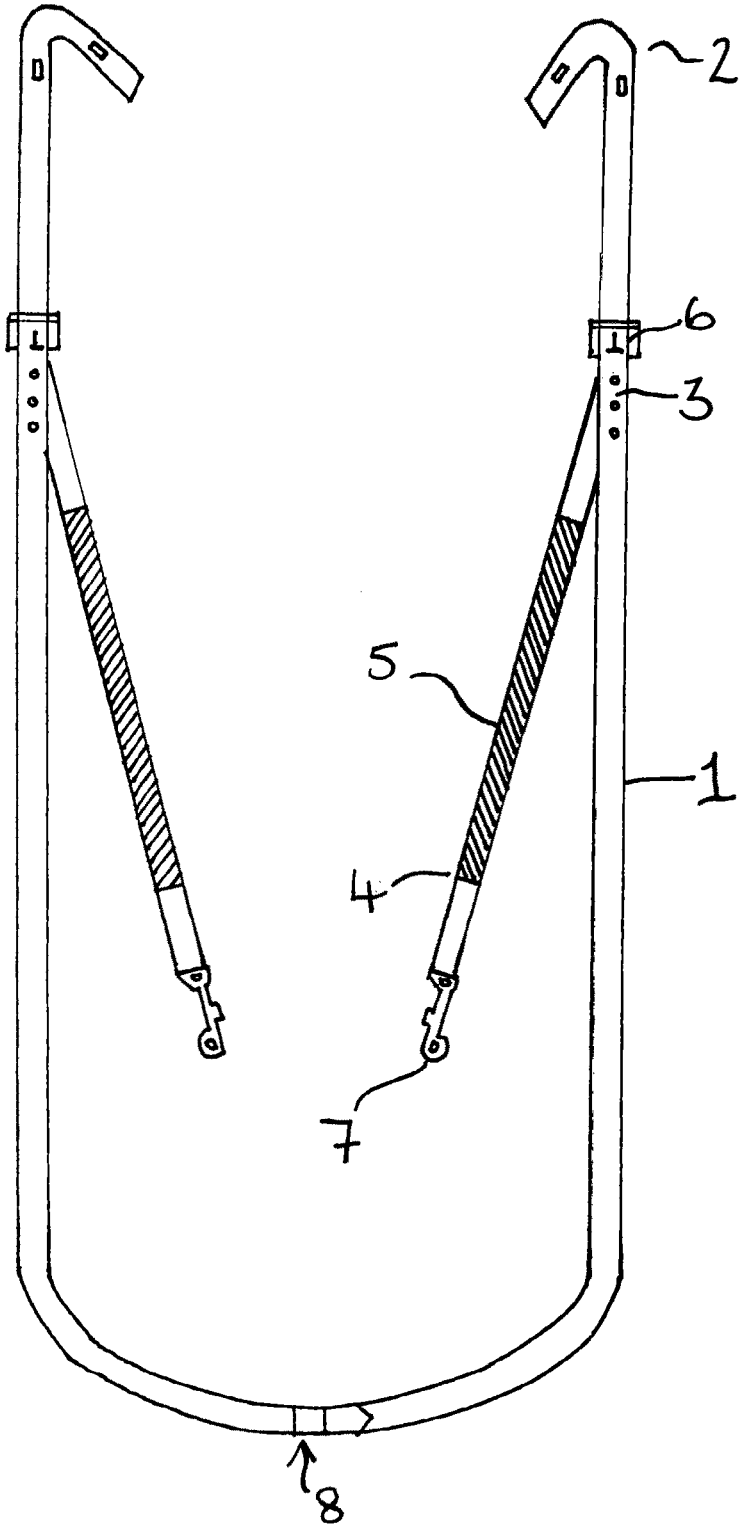
FIG. 1 is a schematic representation in plan view of the equestrian rein.
Figure 4:
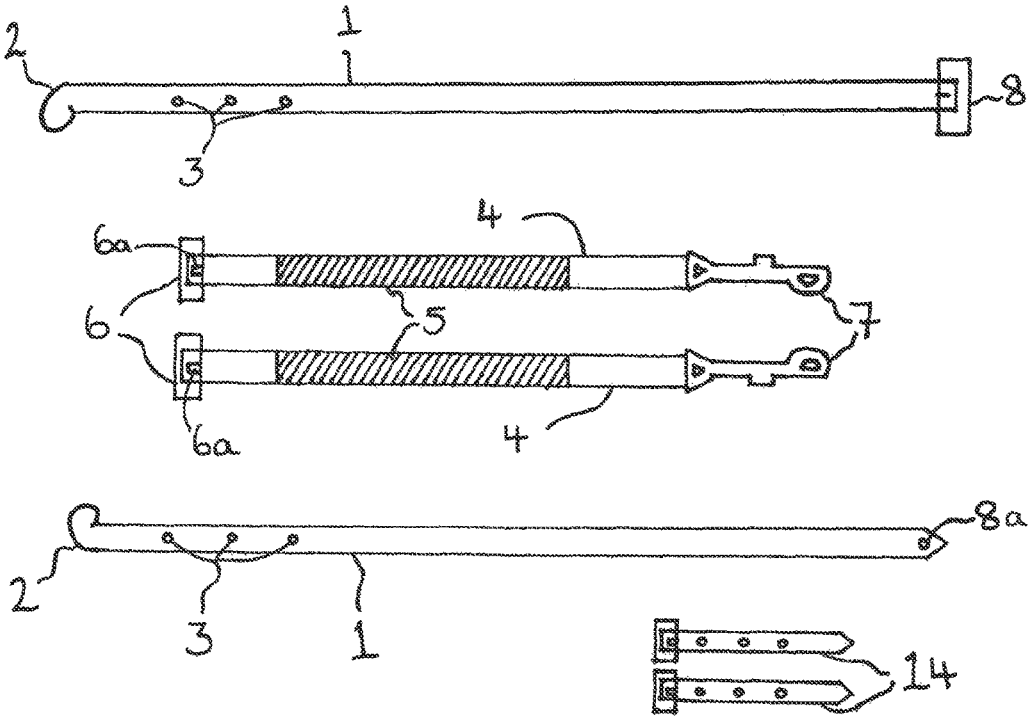
FIG. 4 is a schematic representation of the component parts of the equestrian rein.

FIGS. 1 and 4 illustrate an equestrian rein set according to the invention, the rein set comprising two first reins 1. One end of each first rein 1 comprises attachment means 2 for attachment of the reins 1 to a part of a bridle, for example a bit. The attachment means 2 may be buckles, billets, loops or clips. Alternatively, the end 2 of the rein 1 may be stitched on to a bit ring for example. The other end of each first rein 1 attach to one another. One of the first reins 1 is provided with a buckle 8 with the other of the first reins including a hole 8*a* for receiving the prong of the buckle, thereby attaching the two first reins 1 together.

Each rein 1 includes a plurality of holes 3. These holes 3 allow a buckle to attach to the rein 1.

The rein set comprises two second reins 4. Each second rein 4 includes attachment means at each end thereof. In the illustrated embodiment, at one end of second rein 4 the attachment means is in the form of a buckle 6, the prong 6*a* of which engages one of the holes 3 in the first rein 1, thereby attaching the second rein 4 to the first rein 1. The attachment means at other end of the second rein 4 comprises a spring loaded clip 7, which is opened for attachment to and release from D-rings mounted on a saddle.

Each second rein 4 includes a part 5 formed of a resilient material, such as elastic, so that when a tension force is applied to the second rein 4 the part 5 will stretch.

Figure 2:
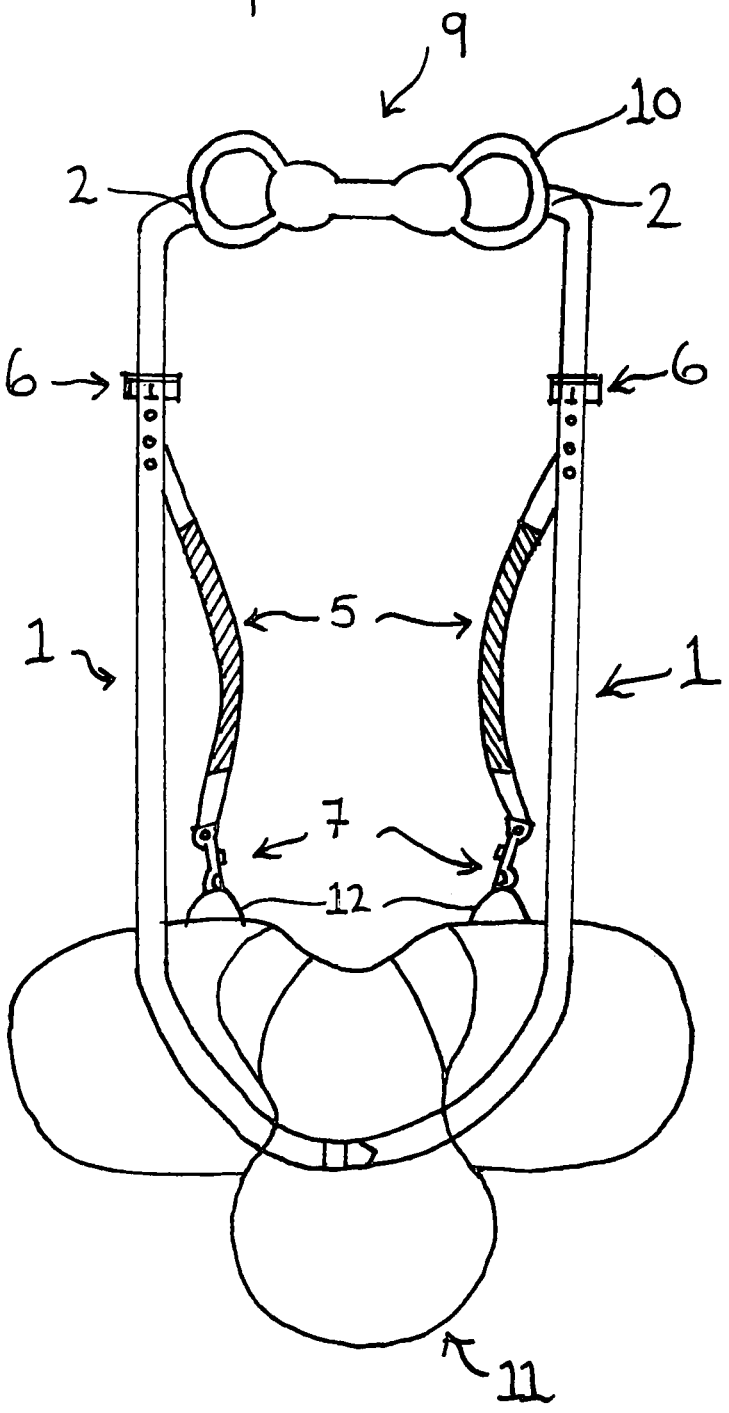
FIG. 2 is a schematic representation in plan view of the equestrian rein in use.

FIG. 2 shows the rein set of the invention with the first reins 1 attached to the rings 10 of a bit 9, and the clips 7 of the second reins 4 attached to D-rings 12 of a saddle 11. Clips 7 need not be used. An alternative attachment means such as a strap may be used. For example a leather strap with a buckle could be used as an alternative to the clips 7 illustrated.

Figure 3:
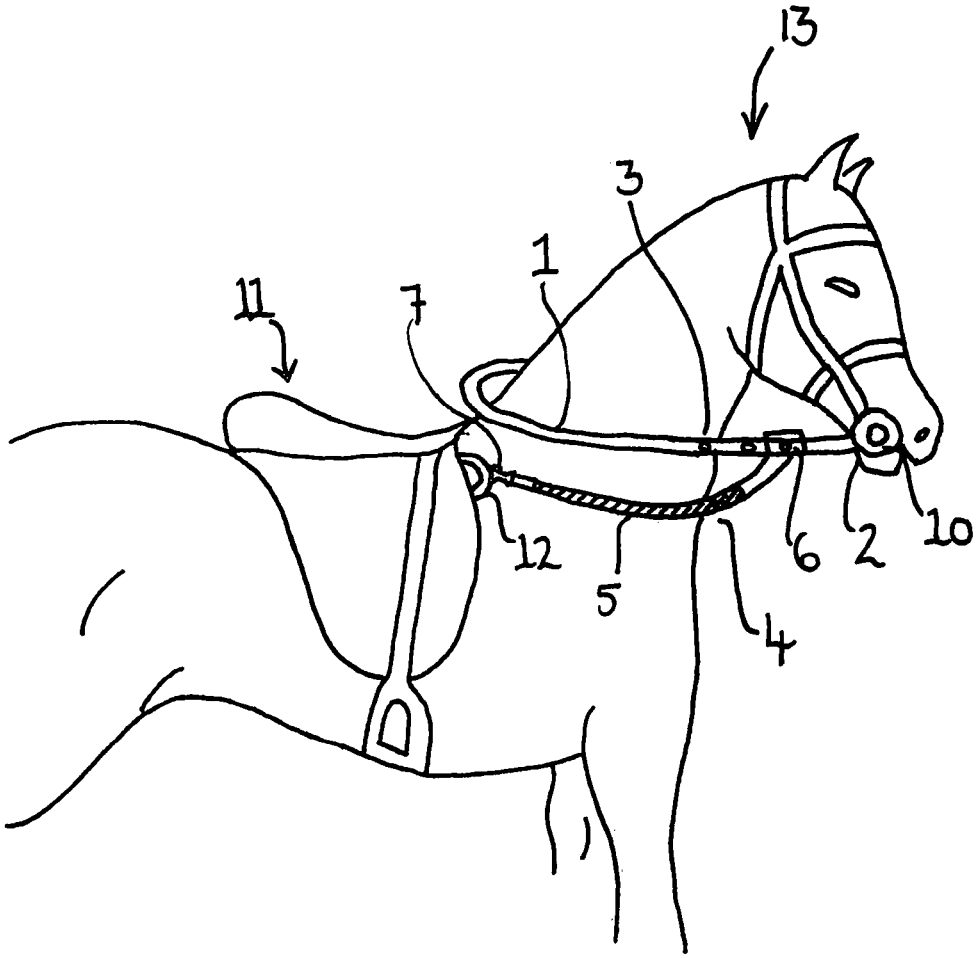
FIG. 3 is schematic representation in side view of the equestrian rein attached to an equine.

FIG. 3 illustrates the rein set of the invention in use on a saddled equine. The equine is equipped with a bridle 13 which supports the bit (see bit 9 in FIG. 2). Each first rein 1 attaches to one of the bit rings 10. The first reins 1 are used by a rider in a conventional manner. Each second rein 4 attaches to one of the first reins 1 and the saddle 11, in this illustrated embodiment attaching to the D-rings 12.

FIG. 4 illustrates the component parts of the rein set of the invention separated from one another, and also shows extension pieces 14, which attach to buckles 6 of the second reins to make each second rein longer, thereby allowing the same second reins to be used with different sized equines.

The action of the rein set will now be described with articular reference to FIG. 3. As will be appreciated by one skilled in the art, with the second rein 4 slack (as shown in FIG. 3) the second rein 4 has very little effect on the first rein 1 and hence the bit 9 and the equine. The rider may use the first reins 1 in the same manner as if the second reins 4 were not present. However, if the equine should extend its head forward or lower its head towards the ground, the second reins 4 would come into tension and where the second reins 4 include a resilient part they would stretch. At the point the second reins 4 come into tension a force is exerted on the equine's mouth via the bit 9. Assuming that the rider is not pulling on the first reins 1, the force exerted on the bit 9 by the second reins 4 is independent of the rider. This is particularly beneficial for young riders whose equine mounts often have an inclination to seek to eat grass whilst being ridden. The dropping of the head to eat grass can pull a child out of the saddle over the equine's head, or simply unbalance the child. The rein set is also useful for inexperience riders when learning to ride. The second reins may be adjusted in length so that a light contact is made by the bit on the equine's mouth. The inexperienced rider may then ride without having to be too concerned about controlling the speed of the equine through the bit, whilst attempting to sit in a balanced fashion in the saddle. The rein set of the invention may also be useful in the training of young equines or equines with undesirable habits, particularly where the second reins include a resilient part that stretches when a tension force is applied thereto. For example, with a young equine, the presence of second rein may teach the young equine how to carry itself so that the bit is most comfortable in its mouth, self-adjustment of the equine's carriage changing the tension in the second reins. Another use for the rein set would be with an equine that is in the habit of snatching at the bit. The action of snatching at the bit would result in a force being exerted on the bit by virtue of the second reins 4. Such snatching would not unbalance the rider since the first reins 1 should not be pulled from the rider's hands.

Another advantage of the rein set of the invention is that the second reins are unobtrusive, and do not affect the appearance of the equine when tacked up.

The rein set of the invention has been described with the second reins being attached to the D-rings of the saddle. Of course the second reins could be attached to another part of the saddle, such as the girth straps. However, the D-rings present a convenient attachment point.

The rein set of the invention has been described with reference to attachment to a bit. However, equines are also ridden using bitless bridles. With a bitless bridle the reins are attached to a part of the bridle through which a controlling force may be transferred via the reins from the rider to the equine. The first rein of the rein set of the invention may of course be attached to part of a bitless bridle.

The rein set may be made from any suitable material used in the manufacture of bridles and reins. Such materials including leather and webbing.

The rein set may be made in a variety of difference sizes to suit difference sized equines.

The invention claimed is:

1. A combination of a bridle, a saddle and an equestrian rein set for a riding horse, the combination comprising:

a bridle;

a saddle;

and an equestrian rein set comprising:

a pair of first reins, each first rein of the pair of first reins having:

two opposing ends, one end comprising a first attachment means attachable to a component of the bridle such that the first reins attach to the component on respective opposing sides of the bridle, and the other end comprising a second attachment means, the second attachment means of the pair of first reins being complementary such that the second attachment means are matingly attachable to each other to connect the first reins to each other, and an intermediate portion between the two opposing ends, the intermediate portion comprising at least one attachment element, and a pair of second reins, each second rein of the pair of second reins having:

two opposing ends, one end comprising third attachment means configured for attachment to the saddle such that the second reins attach to the saddle on respective opposing sides of the saddle, and the other end comprising fourth attachment means configured for attachment to the at least one attachment element of a respective first rein of the pair of first reins;

wherein, in use, each second rein of the pair of second reins extends directly from the saddle to the respective first rein of the pair of first reins to which the second rein is attached.

2. The combination of a bridle, a saddle and an equestrian rein set according claim 1, wherein each second rein of the pair of second reins includes a resilient part.

3. The combination of a bridle, a saddle and an equestrian rein set according to claim 1, wherein the at least one attachment element comprises a plurality of spaced apart attachment elements.

4. The combination of a bridle, a saddle and an equestrian rein set according to claim 1, wherein the at least one attachment element is a hole or a D-ring.

5. The combination of a bridle, a saddle and an equestrian rein set according to claim 1, wherein the third attachment means and/or the fourth attachment means is configured to attach to a D-ring.

6. The combination of a bridle, a saddle and an equestrian rein set according to claim 1, wherein the third attachment means and/or the fourth attachment means includes at least one of one of: a clip, a strap, a tie and a buckle.

7. The combination of a bridle, a saddle and an equestrian rein set according to claim 1, wherein each first rein of the pair of first reins has an inner surface and an outer surface and wherein each second rein of the pair of second reins is attachable to the inner surface of the respective first rein of the pair of first reins.

* * * * *